US006483256B2

(12) United States Patent
Heckmann

(10) Patent No.: US 6,483,256 B2
(45) Date of Patent: Nov. 19, 2002

(54) OPERATING DEVICE FOR DISCHARGE LAMPS WITH SWITCH RELIEF FOR THE PREHEATING OF ELECTRODE FILAMENTS

(75) Inventor: Markus Heckmann, Munich (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/910,793

(22) Filed: Jul. 24, 2001

(65) Prior Publication Data

US 2002/0047617 A1 Apr. 25, 2002

(30) Foreign Application Priority Data

Jul. 28, 2000 (DE) ..... 100 36 950

(51) Int. Cl.[7] ..... H05B 41/16; H05B 37/00
(52) U.S. Cl. ..... 315/276; 315/224
(58) Field of Search ..... 315/276, 224, 315/219, 205, 295

(56) References Cited

U.S. PATENT DOCUMENTS 4,297,616 A * 10/1981 Corona ..... 315/179
5,841,239 A * 11/1998 Sullivan et al. ..... 315/219
5,864,212 A * 1/1999 Sullivan ..... 315/205
6,094,016 A * 7/2000 Luger et al. ..... 315/295

* cited by examiner

*Primary Examiner*—Don Wong
*Assistant Examiner*—Hoang Nguyen
(74) *Attorney, Agent, or Firm*—Carlo S. Bessone

(57) ABSTRACT

In order to heat filaments of discharge lamps, use is often made of a filament transformer (L11, L12, L13) in the associated operating devices. Particularly in the case of preheating the filaments, there is then a lack of a sufficiently high inductive component in the load current in order to ensure turn-on relief of the half-bridge switches (S1, S2) for operating devices with a half-bridge circuit. By inserting an air gap into the filament transformer (L11, L12, L13) the switch relief can be effected even in the case of preheating or of a low dimming setting.

9 Claims, 1 Drawing Sheet

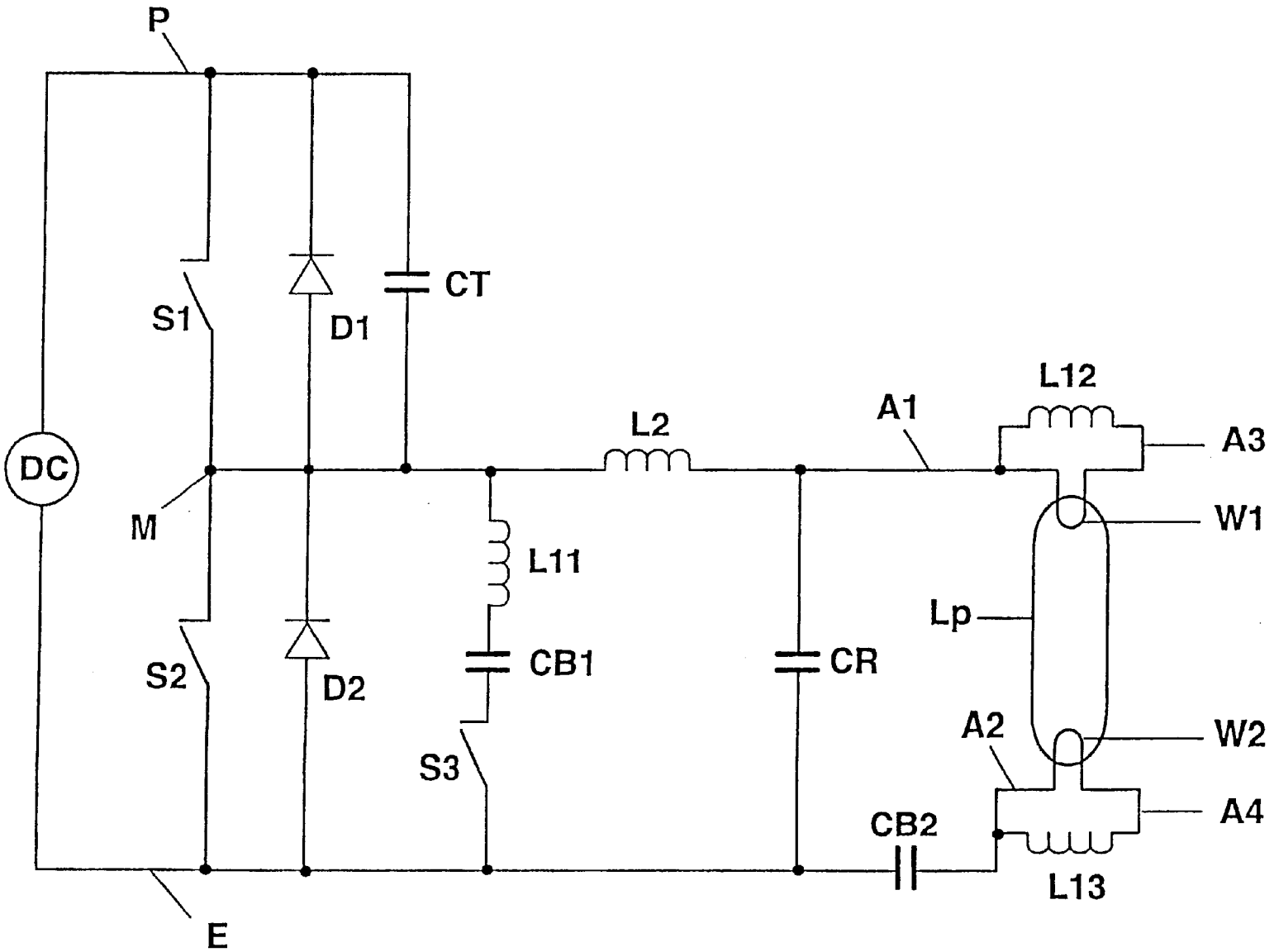
A3
W1
W2
A4
L12
L13
A1
Lp
A2
CB2
CR
L2
L11
CB1
S3
CT
D1
D2
P
S1
M
S2
E
DC

OPERATING DEVICE FOR DISCHARGE LAMPS WITH SWITCH RELIEF FOR THE PREHEATING OF ELECTRODE FILAMENTS

TECHNICAL FIELD

The invention proceeds from an operating device for discharge lamps in accordance with the preamble of claim 1. This is, in particular, a circuit in which the possibilities for heating electrode filaments (W1, W2) are improved.

PRIOR ART

It is known that gas discharge lamps reach a longer service life when their electrodes are heated up before being started. It is customary to employ the term preheating for this. As a rule, the electrodes are designed for this purpose as filaments to which a preheating current is applied for the purpose of the preheating. A heating current through the filaments can also be desired during operation of the lamp in order to maintain a specific filament temperature. This is the case, in particular, in the dimming of a lamp.

A circuit for heating filaments which seems to be independent of the operation of the gas discharge is disclosed in patent EP 0 707 438. The primary winding (L11) of a filament transformer (L11, L12, L13) is connected in parallel with one of the two half-bridge switches for this purpose. Connected in series therewith is a coupling capacitor (CB1) so as substantially to absorb the DC component of the AC voltage supplied by the half bridge. Moreover, an electronic switch (S3) can also be present in series with the primary winding and can be used to turn the heating of the filaments on and off, or the level of heating can be set by means of a pulse control operation. The filament transformer (L11, L12, L13) has a plurality of secondary windings (L12, L13) which supply the heating current for the filaments (W1, W2). Some operating devices have filament-monitoring circuits which operate with a direct current which is small by comparison with the lamp current. In order not to impair the functioning of these circuits, the flow of direct current through the secondary windings must be prevented in at least one direction. This can be achieved by the series circuit of a capacitor or a diode in relation to the respective secondary winding. If only one lamp is being operated, a secondary winding (L12, L13) is present as a rule for each filament. It may be desired in exceptional cases to heat only one filament. When a plurality of lamps connected in series are being operated, a common secondary winding suffices for the interconnected filaments. As explained below, the possibility of the free selection of the heating current for the filaments by appropriate dimensioning of the filament transformer and/or pulse control operation is limited.

An electronic operating device generally has a generator which is constructed with the aid of electronic switches and outputs a voltage at high frequency by comparison with the system voltage frequency. The energy for operating lamps is thereby made available via suitable reactance two-port networks. The high operating frequency entails a high switching rate for the electronic switches, as a result of which it becomes important for the individual switching operation of an electronic switch to proceed with as little loss as possible. The literature discloses several circuit topologies which permit resonant and/or quasi-resonant switching and thus keep the switching losses low. The half bridge has become established as standard topology for the field of electronic operating devices for lamps. What is involved here is a series circuit, connected between an intermediate circuit potential (P) and a reference potential (E) of an operating voltage (DC), of two electronic switches (S1, S2). The connecting point (M) of the switches is connected by alternate closing and opening of the switches to the intermediate circuit potential (P) and the reference potential (E). If a switch is now to effect a change in potential of the connecting point (M) by means of a closing operation, there is at first a high voltage at the switch, which drops to a low value in the course of the switching operation. Since the switch must carry current right at the start of a switching operation, this gives rise to high switching losses. The aim is therefore that a switch is turned on only when a low voltage is present across it. The half bridge now offers the possibility of such ZVS (Zero-Voltage-Switching). If specific preconditions are fulfilled, the potential of the connecting point (M) changes automatically (in a quasi-resonant fashion) upon opening of a switch from one potential of the operating voltage (DC) to the other without the need for another switch to be closed. After the automatic change in potential, the other switch can be turned on virtually without loss. In order not to let the automatic change in potential proceed too quickly, a load-relieving capacitor (CT) is frequently connected in parallel to at least one of the two switches. As a result, the losses in the opening switch are reduced and the interference produced by the switching operation is diminished.

It is therefore necessary to attempt to create conditions which deflect an automatic change in potential at the connecting point (M) upon opening of a switch of a half bridge. A necessary condition for this consists in that the load fed by the half bridge must exhibit inductive behavior. The reactance two-port network (Z) for coupling the lamps to the half bridge generally includes a lamp inductor (L2). In normal operation of the lamp, it is therefore easy to set an operating frequency at which the load of the half bridge acts inductively. If, by contrast, the above-described filament transformer (L11, L12, L13) is used to preheat the filaments (W1, W2), and if the lamps are in the preheating phase, the contribution of the lamp inductor (L2) to the load impedance is too low to relieve the half-bridge switches (S1, S2) reliably. The inductance of the lamp inductor (L2) can be adapted in order to counteract this effect. However, this is seldom possible since a the lamp inductor (L2) must be optimized for normal operation. It is also possible to reduce the capacitance of the load-relieving capacitor (CT) in order to increase the inductance of the load impedance. However, this entails the following disadvantages: the turn-off losses of the half-bridge switches (S1, S2) are increased, the radio interference which the operating device generates becomes stronger and the possibilities for building up an energy supply from auxiliary circuits from the current through the load-relieving capacitor (CT) are constrained.

SUMMARY OF THE INVENTION

It is an object of the present invention to provide an operating device in accordance with the preamble of claim 1 which also ensures in preheating operation that the half-bridge switches (S1, S2) are turned on in a virtually de-energized fashion.

This object is achieved in the case of an operating device with the features of the preamble of claim 1 by means of the features of the characterizing part of claim 1. Particularly advantageous refinements are to be found in the dependent claims.

The lamps are connected via a reactance network to the AC voltage supplied by the half bridge at the midpoint potential (M). Said network mostly comprises a series resonant circuit comprising the lamp inductor (L2) and a resonance capacitor (CR). There is a need for there to be connected in series with the lamps a coupling capacitor (CB2), which absorbs the DC voltage component of the AC voltage supplied by the half bridge. This coupling capacitor (CB2) can also be of dual design, in which case one is connected to the intermediate circuit potential (P) and one is connected to the reference potential (E). For starting purposes, the switching frequency of the half bridge is close to the resonant frequency of the resonant circuit (L2, CR).

The lamps are not started during preheating, that is to say no lamp current flows. The lamp voltage must not be high during preheating, in order to avoid a premature gas discharge in the lamp. The current through the resonant circuit is therefore also low. It follows that the lamp current is substantially influenced during preheating by the current in the primary winding of the filament transformer (L11, L12, L13). At the moment when the half bridge switch (T1, T2) is turned off, the load must have stored sufficient energy, as conditioned by its inductive character, to effect a change in the potential of the connecting point (M). It is normal to try to achieve properties of a transformer which come as close as possible to those of an ideal transformer. The known filament transformers therefore have no air gap. An attempt is made at least to keep the production-induced air gap as small as possible. According to the invention, an air gap is now deliberately inserted into the filament transformer (L11, L12, L13). The filament transformer (L11, L12, L13) can therefore store energy. When a half-bridge switch is turned off, this energy effects a change in the potential of the connecting point (M), and thus causes the half-bridge switches (S1, S2) to be turned on in a virtually de-energized fashion and with low loss.

The width of a production-induced air gap in a transformer which is not intended to contain any air gap is substantially below 0.1 mm. An air gap which is intended to exhibit an effect according to the invention in conventional operating devices must have a width of at least 0.1 mm. It is therefore easily possible to distinguish between an air gap according to the invention and one not according to the invention.

A coupling capacitor (CB1) is mostly connected in series with the primary winding of the filament transformer (L11, L12, L13). It serves firstly to couple out the DC voltage component of the AC voltage generated by the half bridge. Given appropriate dimensioning, however, it can also be used to determine the strength of the heating current. A switch (S3) can also be connected in series with the primary winding of the filament transformer (L11, L12, L13). Said switch can either turn the heating of the filaments (W1, W2) on and off, or regulate the heating current in the pulse control operation.

The problem of turning on the half-bridge switches in the de-energized fashion also applies equivalently to switches which are connected in a full bridge arrangement. One half of the full bridge can respectively be interpreted as a half bridge for which the above statements are valid.

DESCRIPTION OF THE DRAWING

The invention is explained in more detail below with the aid of an exemplary embodiment. The FIGURE shows a circuit in which the filament transformer (L11, L12, L13) according to the invention is provided with an air gap.

Between an intermediate circuit potential (P) and a reference potential (E), an operating voltage source (DC) supplies a DC voltage to a circuit in the FIGURE. The half bridge, which is formed from the series circuit of two switches (S1, S2), is connected to this DC voltage source (DC). The half bridge generates an AC voltage of high frequency by comparison with the system voltage frequency at the connecting point (M) of the switches. A free wheeling diode (D1, D2) is connected in parallel with this switch. A load-relieving capacitor (CT) is connected in parallel with the upper switch (S1). The load-relieving capacitor (CT) could also be connected in parallel with the lower switch (S2) in a way producing the same effect. The primary circuit of the filament heating circuit is connected in parallel with the lower switch (S2). It is formed from the series connection of a first coupling capacitor (CB1) to a switch (S3) and the primary winding (L11) of the filament transformer (L11, L12, L13). The primary circuit of the filament could also be connected in parallel with the upper switch (S1) to produce the same effect. The lamp inductor (L2) is connected to the connecting point (M) of the half-bridge switches (S1, S2). A first lamp connection (Al) is connected to the other end of the lamp inductor. Also connected thereto is a connection of the resonance capacitor (CR). The other connection of the resonance capacitor (CR) is connected to a reference potential (E) of the operating voltage (DC). A second connection of the lamp (A2) is also connected to the reference potential (E) via a second coupling capacitor (CB2). Instead of being connected to the reference potential (E), the resonance capacitor (CR) can also be connected with the same effect to the second lamp connection (A2). The first filament (W1) of the lamp (Lp) is connected between the first lamp connection (A1) and a third one (A3). A secondary winding (L12) of the filament transformer (L11, L12, L13) is connected in parallel therewith. The second filament (W2) of the lamp (Lp) is connected between the second lamp connection (A4) and a fourth one (A4). A secondary winding (L13) of the filament transformer (L11, L12, L13) is connected in parallel therewith. A circuit with only one lamp (Lp) is specified in the FIGURE. However, the circuit can also be used for a plurality of series-connected lamps. The filament transformer (L11, L12, L13) must then be complemented by further secondary windings in accordance with the filaments then to be heated.

What is claimed is:

1. Electronic ballast for gas discharge lamps with heatable elements, which has the following features:

a DC supply (DC) between an intermediate circuit potential (P) and a reference potential (E), two series-connected electronic switches (S1, S2) which form a half bridge with a midpoint potential (M), one of the switches (S1) being connected to the intermediate circuit potential (P) and the other (S2) being connected to the reference potential (E), and the switches (S1, S2) switching on and off alternately such that an AC voltage is produced at the midpoint potential (M), a filament transformer (L11, L12, L13) with a core which, on the secondary side (L12, L13), outputs energy to the filaments (W1, W2) and on the primary side (L11) draws its energy from the AC voltage generated by the half bridge, characterized in that the core of the filament transformer has an air gap which is active with reference to the electrical data of the filament transformer (L11, L12, L13).

2. Operating device according to claim 1, characterized in that the air gap is at least 0.1 mm wide.

3. Operating device according to claim 1, characterized in that a load-relieving capacitor (CT) is connected in parallel with at least one half-bridge switch (S1, S2).

4. Operating device according to claim 1, characterized in that the lamps are connected to the half bridge via a series resonant circuit comprising a lamp inductor (L2) and a resonance capacitor (CR), the lamps being connected in parallel with the resonance capacitor (CR), and in that the current through the lamps must flow through at least one coupling capacitor (CB2).

5. Operating device according to claim 1, characterized in that the filament transformer (L11, L12, L13) supplies heating current to at least one lamp filament (W1, W2) by parallel connection of a secondary winding (L12, L13).

6. Operating device according to claim 5, characterized in that connected in series with at least one secondary winding (L12, L13) is an electric component which prevents the flow of an electric direct current to the relevant secondary winding in at least one direction.

7. Operating device according to claim 1, characterized in that the primary winding (L11) of the filament transformer (L11, L12, L13) is connected in a primary circuit which is in parallel with one of the two half-bridge switches (S1, S2).

8. Operating device according to claim 7, characterized in that the primary circuit comprises the series connection of the primary winding (L11), a further coupling capacitor (CB1) and a further electronic switch (S3).

9. Operating device according to claim 1, characterized in that the half bridge is extended by two further electronic switches to form a full bridge.

* * * * *